US012791237B2

(12) United States Patent
Cai

(10) Patent No.: US 12,791,237 B2
(45) Date of Patent: Nov. 10, 2026

(54) REFRIGERATION SYSTEM AND METHOD OF DETERMINING A LOSS OF CHARGE OF REFRIGERANT THEREIN

(71) Applicant: Maersk Container Industry A/S, Tinglev (DK)

(72) Inventor: Junping Cai, Tinglev (DK)

(73) Assignee: Maersk Container Industry A/S, Tinglev (DK)

( * ) Notice: Subject to any disclaimer, the term of this patent is extended or adjusted under 35 U.S.C. 154(b) by 169 days.

(21) Appl. No.: 18/604,988

(22) Filed: Mar. 14, 2024

(65) Prior Publication Data

US 2024/0219089 A1 Jul. 4, 2024

Related U.S. Application Data

(63) Continuation of application No. PCT/EP2022/077607, filed on Oct. 4, 2022.

(30) Foreign Application Priority Data

Oct. 5, 2021 (DK) ..... PA202100953

(51) Int. Cl.
*F25B 49/02* (2006.01)
*F25B 49/00* (2006.01)

(52) U.S. Cl.
CPC ..... *F25B 49/005* (2013.01); *F25B 2500/222* (2013.01); *F25B 2700/13* (2013.01)

(58) Field of Classification Search
CPC ..... F25B 45/00; F25B 49/005; F25B 49/02; F25B 2345/00; F25B 2345/003; F25B 2500/222
See application file for complete search history.

(56) References Cited

U.S. PATENT DOCUMENTS

| | | | | |
|---|---|---|---|---|
| 5,481,884 | A * | 1/1996 | Scoccia | F25B 49/005 62/127 |
| 9,869,499 | B2 * | 1/2018 | Liu | F25B 45/00 |
| 11,131,471 | B1 | 9/2021 | Butler et al. | |
| 2006/0021362 | A1 | 2/2006 | Sadegh et al. | |
| 2006/0144059 | A1 | 7/2006 | Kang et al. | |

(Continued)

FOREIGN PATENT DOCUMENTS

| | | |
|---|---|---|
| EP | 2257749 A2 | 12/2010 |
| EP | 3201539 A1 | 8/2017 |

(Continued)

OTHER PUBLICATIONS

Danish Technical Examination report and Search report dated Feb. 25, 2022 for Danish Application No. PA202100953.

(Continued)

*Primary Examiner* — Jonathan Bradford
(74) *Attorney, Agent, or Firm* — Fish & Richardson P.C.

(57) ABSTRACT

Provided is a method of determining a loss of charge of refrigerant in a refrigeration system. The method comprises determining at least one performance characteristic of the refrigeration system. The at least one performance characteristic comprises a mass flow rate of the refrigerant in the refrigeration system. The method further comprises, when (Continued)

one or more predetermined criteria are met on the basis of the performance characteristic, determining a loss of charge in the refrigeration system.

19 Claims, 3 Drawing Sheets

(56) References Cited

U.S. PATENT DOCUMENTS

| | | | |
|---|---|---|---|
| 2010/0088046 | A1 | 4/2010 | Schuster et al. |
| 2013/0086932 | A1 | 4/2013 | Ishizeki et al. |
| 2013/0160470 | A1 | 6/2013 | Schuster et al. |
| 2013/0298995 | A1 | 11/2013 | Mcmasters et al. |
| 2015/0377532 | A1 | 12/2015 | Uselton |
| 2019/0170415 | A1 | 6/2019 | Walser et al. |
| 2019/0362036 | A1 | 11/2019 | Zhang et al. |

FOREIGN PATENT DOCUMENTS

| | | | |
|---|---|---|---|
| EP | 3252402 | A1 | 12/2017 |
| EP | 3279589 | A1 | 2/2018 |
| WO | 2016050415 | A1 | 4/2016 |
| WO | 2017087628 | A1 | 5/2017 |
| WO | 2020141279 | A1 | 7/2020 |
| WO | 2021050704 | A1 | 3/2021 |
| WO | 2021219474 | A1 | 11/2021 |

OTHER PUBLICATIONS

International Search Report and Written Opinion dated Jan. 30, 2023 for PCT Application No. PCT/EP2022/077607.

Danish Technical Examination report and Search report dated Mar. 8, 2022 for Danish Application No. PA202101075.

Danish Technical Examination report and Search report dated Oct. 25, 2022 for Danish Application No. PA202101075.

International Search Report and Written Opinion dated Feb. 17, 2023 for PCT Application No. PCT/EP2022/082040.

ISO 20854:2019, "Thermal containers—safety standard for refrigerating systems using flammable refrigerants—requirements for design and operation", Oct. 2019.

ISO 12100:2010, "Safety of machinery—general principles for design—risk assessment and risk reduction" Nov. 2010.

* cited by examiner

REFRIGERATION SYSTEM AND METHOD OF DETERMINING A LOSS OF CHARGE OF REFRIGERANT THEREIN

CROSS-REFERENCE TO RELATED APPLICATIONS

This application is a continuation under 35 U.S.C. § 120 of International Application No. PCT/EP2022/077607, filed Oct. 4, 2022, which claims priority to Denmark Application No. PA202100953, filed Oct. 5, 2021 under 35 U.S.C. § 119(a). Each of the above-referenced patent applications is incorporated by reference in its entirety.

TECHNICAL FIELD

The present invention relates to methods of determining a loss of charge of refrigerant in a refrigeration system, controllers, refrigeration systems, storage units and marine vessels.

BACKGROUND

Many types of cargo may be stored in transportable storage units, also referred to as transport units, for transporting cargo on container vessels. Such a storage unit may comprise an atmosphere control system for controlling an atmosphere in the storage unit. This may be used to facilitate the storage and transportation of perishable goods, such as fruit, vegetables, or fresh or frozen meat or fish, or other goods, such as medicaments, in the transport unit. Transport units include reefer containers, which may be TEU or 2-TEU containers designed to be shipped on container vessels, and/or refrigerated trucks or trailers.

Refrigeration systems of storage units are designed to be operated at or above a particular level of charge. Inventions as described herein solve problems with determining a loss of charge of refrigerant in refrigeration systems, such as to allow remedial action to be taken to ensure the refrigeration unit is operating efficiently.

SUMMARY

According to a first aspect of the present invention, there is provided a method of determining a loss of charge of refrigerant in a refrigeration system, the method comprising: determining at least one performance characteristic of the refrigeration system, wherein the at least one performance characteristic comprises a mass flow rate of the refrigerant in the refrigeration system; and, when one or more predetermined criteria are met on the basis of the performance characteristic, determining a loss of charge in the refrigeration system.

This may provide an improved way to detect a loss of charge of refrigerant, such as without requiring an external gas sensor for detecting a presence of refrigerant outside the refrigeration system. This may reduce a complexity, cost and/or case of maintenance of the refrigeration system, while providing a more direct way to determine whether any refrigerant has been lost from the refrigeration system. The method may also provide a quicker and/or more accurate determination of a loss of charge compared to other methods, such as using an external gas sensor.

Optionally, the method comprises determining whether the one or more predetermined criteria have been met, and determining the loss of charge on the basis of a determination that the one or more predetermined criteria have been met.

Optionally, the refrigeration system is a refrigeration system for a storage unit. Optionally, the storage unit comprises a space for storing cargo. Optionally, the storage unit is a reefer container, or refrigerated truck or trailer, such as for transporting the cargo. Optionally, the refrigeration system is part of an atmosphere control system for controlling an atmosphere in the space. Optionally, the refrigeration system and/or the atmosphere control system is configured to cool the space to cool the cargo stored in the space. Optionally, the cargo comprises fresh or frozen produce, which may include respirating and/or ripenable produce such as fruit and vegetables, and/or non-respirating fresh produce, meat and/or fish. The cargo may comprise medicaments, such as vaccines. It will be appreciated that the cargo may be any suitable cargo that may require, or benefit from, being stored in an atmosphere-controlled space.

A quicker and/or more accurate determination of a loss of charge in the refrigeration system, such as provided by the present method, may be particularly advantageous when applied to refrigeration systems for such storage units. In particular it may allow remedial action to be taken to alleviate any risks associated with refrigerant being present in or around the storage unit, such as in the space, especially where the refrigerant is flammable.

Optionally, the at least one performance characteristic is determined based on one or more measured thermofluidic parameters of refrigerant in the refrigeration system and/or of an external fluid associated with an evaporator and/or condenser of the refrigeration system, such as one or more measured temperatures and/or pressures of the refrigerant and/or the external fluid. For instance, the mass flow rate may be monitored using pressure sensors which are already installed in the refrigeration system, thereby making further use of thermofluidic parameters that are already measured in the refrigeration system. This may advantageously allow the method to be performed on a refrigeration system without requiring the installation of additional components, such as additional sensors for sensing the thermofluidic parameters, or external components such as gas sensors for detecting the presence of refrigerant outside the refrigeration system, such as in the space for storing cargo.

Optionally, the at least one performance characteristic comprises: a compressor mass flow rate, being a mass flow rate of refrigerant through a compressor of the refrigeration system. Optionally, the at least one performance characteristic comprises an expansion valve mass flow rate, being a mass flow rate of refrigerant through an expansion valve of the refrigeration system. Optionally, the one or more predetermined criteria being met comprises a differential mass flow rate, being a comparison between the compressor mass flow rate and the expansion valve mass flow rate, exceeding a mass flow rate threshold.

A loss of charge in the system may lead to a disparity between the compressor mass flow rate and the expansion valve mass flow rate. Specifically, the expansion valve mass flow rate may be higher than the compressor mass flow rate if there is a loss of charge in the system. This loss of charge may reduce a liquid level in a receiver upstream of the expansion valve, which may cause vaporous refrigerant to enter a liquid line between the receiver and the expansion valve. Vapour present at the expansion valve may occupy disproportionally more volume in an orifice of the expansion valve than liquid refrigerant, and may thereby reduce an effective mass flow rate through the expansion valve. The orifice of the expansion valve may be opened further to compensate for this restriction, leading to an increased mass flow rate through the expansion valve compared to the mass flow rate through the compressor, which may remain unchanged. Determining whether the differential mass flow rate has exceeded a threshold may provide a quick, convenient and accurate way of determining whether there has been a loss of charge in the refrigeration system.

Optionally, the method comprises determining whether the differential mass flow rate exceeds the mass flow rate threshold. The determining whether the differential mass flow rate exceeds the mass flow rate threshold may be referred to herein as the "intermediate mass flow determination".

Optionally, the differential mass flow rate is a ratio between the compressor mass flow rate and the expansion valve mass flow rate. Alternatively, the differential mass flow rate is a difference between the compressor mass flow rate and the expansion valve mass flow rate.

Optionally, the expansion valve is an evaporator expansion valve configured to provide refrigerant to the evaporator, such as to reduce a pressure of refrigerant supplied to the evaporator. Optionally, the compressor is a single stage compressor. Optionally, the expansion valve is an economiser expansion valve, configured to provide refrigerant to an economiser heat exchanger for cooling refrigerant upstream of the evaporator expansion valve. Optionally, the compressor is a multi-stage compressor, and the compressor mass flow rate is a mass flow through one or more stages of the compressor.

Optionally, the method comprises performing the intermediate mass flow determination on the basis of a determination that the differential mass flow rate is less than or equal to a further mass flow rate threshold that is greater than the mass flow rate threshold. Optionally, the method comprises determining whether the differential mass flow rate is greater than the further mass flow rate threshold. The determining whether the differential mass flow rate is greater the further mass flow rate may be referred to herein as the "principal mass flow determination".

Optionally, the loss of charge in the refrigeration system is determined on the basis of, such as in response to, a positive principal mass flow determination. That is, a positive principal mass flow determination, in which the mass flow rate exceeds a larger threshold, may be more clearly indicative of a loss of charge in the refrigeration system than the intermediate mass flow determination. This may provide a quicker and/or more accurate determination of the loss of charge.

Optionally, the at least one performance characteristic comprises an amount of superheat of refrigerant, the superheat being associated with an evaporator of the refrigeration system. Optionally, the one or more predetermined criteria being met comprises the amount of superheat exceeding a superheat threshold.

Optionally, the method comprises determining whether the amount of superheat exceeds the superheat threshold. The determining whether the amount of superheat exceeds the superheat threshold may be referred to herein as the "intermediate superheat determination".

Optionally, the one or more predetermined criteria being met comprises: the amount of superheat exceeding the superheat threshold; and the differential mass flow rate exceeding the mass flow rate threshold. That is, the method may comprise determining the loss of charge in the refrigeration system on the basis of both a positive intermediate superheat determination and a positive intermediate mass flow determination.

This may provide a more definitive determination of a loss of charge in the event that positive intermediate superheat and mass flow determinations alone are inconclusive as to the loss of charge. For instance, a positive principal mass flow determination may be clearly indicative of a loss of charge, but further information may need to be obtained to determine a loss of charge, such as by performing the intermediate superheat determination, if the mass flow rate is between the threshold and the further threshold. This may provide improved confidence in the determination of a loss of charge where the mass flow rate is between the threshold and the further threshold.

Optionally, the method comprises determining whether: the amount of superheat exceeds the superheat threshold, and whether the differential mass flow rate exceeds the mass flow rate threshold, on the basis of a determination that the amount of superheat is less than or equal to a further superheat threshold that is greater than the superheat threshold.

Optionally, the method comprises determining that the amount of superheat is greater than the further superheat threshold. The determining that the amount of superheat is greater than the further superheat threshold may be referred to herein as the "principal superheat determination".

Optionally, the loss of charge in the refrigeration system is determined on the basis of, such as in response to, a positive principal superheat determination. That is, a positive principal superheat determination, in which the superheat exceeds a larger threshold, may be more clearly indicative of a loss of charge in the refrigeration system than the intermediate superheat determination and/or the intermediate mass flow determination. Performing the positive principal superheat determination, such as in response to a negative principal and/or intermediate mass flow determination, may provide a quicker and/or more accurate determination of a loss of charge.

Optionally, the loss of charge in the refrigeration system is determined on the basis of, such as in response to, a negative principal superheat determination, a positive intermediate superheat determination, and a positive intermediate mass flow determination. Optionally, the loss of charge in the refrigeration system is determined on the basis of, such as in response to, a negative principal mass flow determination, a positive intermediate superheat determination, and a positive intermediate mass flow determination. Optionally, the loss of charge in the refrigeration system is determined on the basis of, such as in response to: a) one or both of a negative principal superheat determination and a negative principal mass flow determination; and b) both a positive intermediate superheat determination and a positive intermediate mass flow determination. Optionally, the loss of charge in the refrigeration system is determined on the basis of, such as in response to, both a positive intermediate superheat determination and a positive intermediate mass flow determination. A positive intermediate superheat determination and positive mass flow determination may together provide more certainty as to the presence of a loss of charge, thereby improving a reliability of the method, particularly where the principal superheat and mass flow determinations are both negative.

Optionally, the method comprises performing one or more of the principal superheat determination, the principal mass flow determination, the intermediate superheat determination, and the intermediate mass flow determination, periodically, such as at intervals of up to 5 minutes, up to 10 minutes, up to 15 minutes, up to 30 minutes, up to 1 hour, or more than 1 hour. Optionally, the method comprises performing one or more of the principal superheat determination, the principal mass flow determination, the intermediate superheat determination, and the intermediate mass flow determination, using sensed data that is continuously and/or intermittently monitored over a predetermined period of time, such as over a period of up to 5 minutes, up to 10 minutes, up to 15 minutes, up to 30 minutes, up to 1 hour, or more than 1 hour.

The mass flow rates and superheats measured in the refrigeration system may be relatively stable and reliable compared, for example, to a capacity associated with an evaporator of the refrigeration system, and/or coefficient of performance associated with a compressor of the refrigeration system. The mass flow rates and superheats can be determined based on pressures in the refrigeration system, such as sensed using pressure sensors in the refrigeration system. It may be quicker and/or more accurate to determine a pressure in the refrigeration system than it is to determine a temperature and/or a relative humidity, such as using temperature and/or relative humidity sensors. As such, the principal and intermediate mass flow and superheat determinations may be quicker and more accurate than other determinations which require information from temperature and/or relative humidity sensors, and/or which may make use of more extensive mathematical models in their determination. The measured superheats and mass flow rates may also be more representative of a current state of the refrigeration system compared to, e.g., the capacity of the evaporator, which may take longer to adjust following a loss of charge in the refrigeration system, or may otherwise require measurements to be taken over longer periods of time to obtain a reliable result. In this way, the principal and intermediate mass flow and superheat determinations may allow more regular and reliable checks on the charge state of the refrigeration system to be made, compared to checks based on certain other performance characteristics discussed below, such as a refrigerant and/or fluid capacity. Measuring the performance characteristics over longer periods of time may improve an accuracy of the mass flow and/or superheat determinations.

Optionally, the performance characteristic comprises any one or more of: a refrigerant capacity, being a rate of heat transfer to refrigerant flowing through an evaporator of the refrigeration system; a fluid capacity, being a rate of heat transfer from an external fluid cooled by the evaporator; a level of subcooling of refrigerant in the refrigeration system; and a coefficient of performance of the refrigeration system. Optionally, the one or more predetermined criteria being met comprises any one or more of: the refrigerant capacity meeting, or exceeding, a theoretical maximum of the fluid capacity; the subcooling of refrigerant meeting, or being below, such as by reducing below, a subcooling threshold; and the coefficient of performance meeting, or being below, such as by reducing below, a performance threshold.

This may provide alternative, or backup, ways of determining a loss of charge in the refrigeration system, such as is in the event of negative principal and intermediate mass flow and superheat determinations. This may improve a reliability of the method.

Any of the one or more performance characteristics may be determined based any other of the one or more performance characteristics. Optionally, the one or more performance characteristics comprises any one or more of: a flow rate of the external fluid through the evaporator and/or condenser; a speed of a fluid mover configured to move the external fluid through the evaporator and/or the condenser; and a speed of a compressor of the refrigeration system.

Optionally, the method comprises determining whether: the refrigerant capacity meets, or exceeds, the theoretical maximum fluid capacity; the subcooling of refrigerant meets, or is below, the subcooling threshold; and/or the coefficient of performance meets, or is below, the performance threshold. Any such determination may be referred to herein as a "refrigeration cycle abnormality determination".

Optionally, the method comprises performing the refrigeration cycle abnormality determination in response to either: (a) a negative intermediate superheat determination; or (b) a negative intermediate mass flow determination.

Optionally, the method comprises performing the refrigeration cycle abnormality determination on the basis of, such as in response to, either: a) a negative principal superheat and/or mass flow determination, and a negative intermediate superheat determination; b) a negative principal superheat and/or mass flow determination, and a negative intermediate mass flow determination; c) a negative principal mass flow and/or superheat determination, a positive intermediate superheat determination, and a negative mass flow determination; or d) a negative principal superheat and/or mass flow determination, a positive intermediate mass flow determination, and a negative intermediate superheat determination.

In this way, the refrigeration abnormality determination may provide and alternative, or backup, method of determining a loss of charge. This may provide improved reliability, such as by allowing a detection of a loss of charge in the event of a negative intermediate superheat and/or mass flow determination, and/or in the event of both a negative principal superheat and mass flow determination.

Optionally, the method comprises performing the refrigeration cycle abnormality determination periodically, such as at intervals of up to 30 minutes, up to 1 hour, up to 2 hours, or more than 2 hours. Optionally, the method comprises performing the refrigeration cycle abnormality determination using sensed data that is continuously and/or intermittently monitored over a predetermined period of time, such as over a period of up to 30 minutes, up to 1 hour, up to 2 hours, or more than two hours.

The refrigeration cycle abnormality determination may require the one or more performance characteristics to be measured over longer periods of time than the principal and intermediate mass flow and superheat determinations. This may be because the refrigeration cycle abnormality determination makes use of a temperature and/or relative humidity of the external fluid, measurements of which may be less stable and/or less accurate over shorter periods of time than measurements of pressure used in the principal and intermediate mass flow and superheat determinations. The refrigeration cycle abnormality determination may, although performed less regularly, ensure that a loss of charge is detected even in the event of negative principal and/or intermediate mass flow and/or superheat determinations.

Optionally, the method comprises, following the determining the loss of charge in the refrigeration system, causing a remedial action to be taken.

Optionally, the remedial action comprises any one or more of: causing issuance of an alert; preventing operation of the refrigeration system; causing modification of an atmosphere conditioned by the refrigeration system; and causing supply of refrigerant to the refrigeration system.

Performing the remedial action may reduce a risk associated with leakage of refrigerant from the refrigeration system, particularly where the refrigerant is flammable or otherwise hazardous. This may improve a safety associated with a refrigeration system on which the method is performed.

Optionally, the method comprises determining that a loss of charge in the refrigeration system exceeds a charge threshold. For instance, the method may comprise determining a quantity of refrigerant that has been lost from the refrigeration system, and comparing the quantity to the charge threshold. The method may comprise taking remedial action when the loss of charge exceeds the charge threshold. This may allow the refrigeration system to continue operating as normal in the event of a loss of an acceptable quantity of refrigerant.

Optionally, the charge threshold is a predetermined amount of refrigerant that can be lost from the refrigeration system. Optionally, the charge threshold is an amount of refrigerant that could be lost while maintaining a level of performance of the refrigeration system within an allowable performance range. Optionally, the charge threshold is an amount of refrigerant that could be lost without posing a safety risk, such as a fire hazard. For instance, the refrigeration system could be a refrigeration system for a transport unit comprising a space for storing cargo, and the charge threshold may be an amount of refrigerant that can safely be allowed to accumulate in the space. Optionally, the charge threshold is up to 1 kg of refrigerant, up to 1.5 kg of refrigerant, up to 2 kg of refrigerant, up to 3 kg of refrigerant, or more than 3 kg of refrigerant. This may improve a safety and/or efficiency of the refrigeration system, such as by adjusting an operation of the refrigeration system based on the quantity of refrigerant that has been lost.

A second aspect of the present invention provides a controller configured to perform the method of the first aspect. Optionally, the controller is configured to receive signals from the refrigeration system, the signals representative of the measured performance characteristics. The controller may be configured to receive such signals from one or more different refrigeration systems. The controller may be configured to control operation of the refrigeration system. The controller may be a part of the refrigeration system, or may be a remote controller, such as a controller that is communicatively coupled, or couplable, to the refrigeration system. Optionally, the controller is a networked controller, such as a cloud-based controller, and/or is a controller of a marine vessel, or a port-based controller.

It will be appreciated that any of the optional features and advantages of the first aspect may similarly apply to the second aspect.

A third aspect of the present invention provides a non-transitory computer-readable storage medium storing instructions that, if executed by a processor, cause the processor to perform the method of the first aspect.

Optionally, the processor is a processor of the controller of the second aspect. It will be appreciated that any of the optional features and advantages of the first aspect and/or the second aspects may similarly apply to the third aspect.

A fourth aspect of the present invention provides a refrigeration system comprising the controller of the second aspect. Optionally, the refrigeration system comprises the non-transitory computer-readable storage medium of the third aspect. Optionally, the refrigeration system comprises a compressor, an expansion valve, a condenser and an evaporator.

It will be appreciated that any of the optional features and advantages of any of the first to third aspects may similarly apply to the fourth aspect.

A fifth aspect of the present invention provides an atmosphere control system comprising the refrigeration system of the fourth aspect. It will be appreciated that any of the optional features and advantages of any of the first to fourth aspects may similarly apply to the fifth aspect.

A sixth aspect of the present invention provides a storage unit comprising the refrigeration system of the fourth aspect. Optionally, the storage unit comprises the space for storing cargo. Optionally, the refrigeration system is operable to condition an atmosphere in the space.

Optionally, the storage unit comprises the atmosphere control system of the fifth aspect. Optionally, the atmosphere control system is configured to control the atmosphere in the space. Optionally, the atmosphere control system is configured to provide cooled gas to the space. Optionally, the refrigeration system is operable so that the gas supplied to the space is cooled by the evaporator of the refrigeration system.

Optionally, the storage unit is a reefer container, or a refrigerated truck or trailer. It will be appreciated that any of the optional features and advantages of any of the first to fifth aspects may similarly apply to the sixth aspect.

A seventh aspect of the present invention provides a marine vessel comprising the controller of the second aspect, the non-transitory computer-readable storage medium of the third aspect, the refrigeration system of fourth aspect, the atmosphere control system of the fifth aspect, or the storage unit of the sixth aspect.

It will be appreciated that any of the optional features and advantages of any of the first to sixth aspects may similarly apply to the seventh aspect.

BRIEF DESCRIPTION OF DRAWINGS

Embodiments of the invention will now be described, by way of example only, with reference to the accompanying drawings, in which.

DETAILED DESCRIPTION

Figure 1:
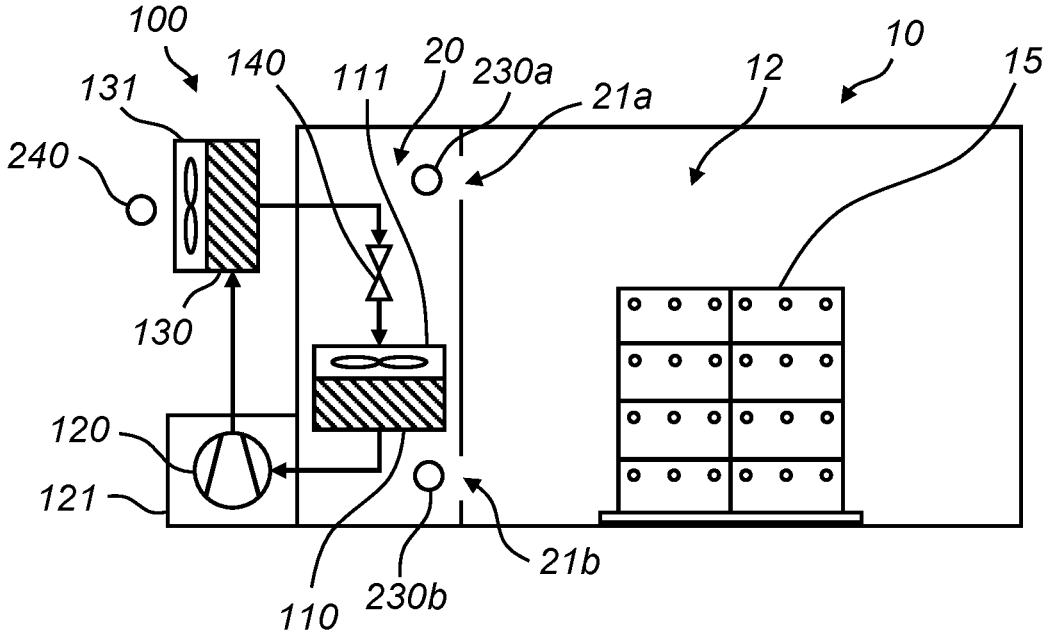
FIG. 1 shows a storage unit comprising a refrigeration system, according to an example.

FIG. 1 shows an example storage unit 10, which here is a transport unit 10, for transporting cargo 15. Specifically, the transport unit 10 is a reefer container for transporting the cargo 15 on a marine vessel, but may alternatively be a refrigerated truck or trailer. In other examples, the storage unit 10 may be any other suitable storage unit 10, such as a storage unit for storing the cargo 15 in in a ripening warehouse or other facility.

The cargo 15 in the illustrated example is fresh or frozen produce. This may include respirating and/or ripenable produce, such as fruit and vegetables, and/or non-respirating fresh produce, meat and/or fish. In other examples, the storage unit 10 may be for transporting any other suitable cargo 15, for example medicaments, such as vaccines. It will be appreciated, however, that the cargo 15 may be any other suitable cargo 15, and may advantageously be cargo 15 that requires, or benefits from, being stored in an atmosphere-controlled space.

The storage unit 10 comprises a space 12 for storing the cargo 15, and an atmosphere control system 20 for controlling an atmosphere in the space 12. Specifically, the atmosphere control system 20 is configured to supply conditioned gas, such as cooled or heated gas, or gas with a specific composition, into the space 12, such as through one or both of a first port 21*a* and a second port 21*b* that each open into the space 12, or via any other suitable fluidic connection between the atmosphere control system 20 and the space 12. In other examples, the atmosphere control system 20, or a part thereof, is located in the space 12.

The illustrated atmosphere control system 20 comprises a refrigeration system 100 configured to condition the gas to be the supplied to the space 12. Specifically, the refrigeration system 100 comprises an evaporator 110, which acts as a heat exchanger to cool gas supplied to the space. The refrigeration system 100 comprises an evaporator gas moving device 111, which here is a fan 111, to draw the gas through, or across, the evaporator 110. The evaporator 110 comprises a fin-and-tube heat exchanger for exchanging heat between a refrigerant flowing in the evaporator 110 and the gas passed through the evaporator 110, but may alternatively be of any other suitable construction.

The evaporator gas moving device 111 is specifically configured to draw gas from the space 12, such as through the second port 21*b*, and to supply gas conditioned by the evaporator 110 to the space 12, such as through the first port 21*a*. The evaporator gas moving device 111 may be selectively operable in a forward and a reverse direction, such as to change which of the first and second ports 21*a*, 21*b* the conditioned gas is supplied to and/or received from. In other examples, the evaporator 110 and/or the evaporator gas moving device 111 may be located in the space 12.

The refrigeration system 100 also comprises a compressor 120, a condenser 130, a condenser gas moving device 131 and an expansion valve 140. The compressor 120 is shown located in a compartment 121 of the storage unit 10, but may alternatively be in any other suitable location, such as within the atmosphere control system 20 compartment, or within the space 12. The condenser 130 is located so as to interface with an external atmosphere surrounding the storage unit 10. In some examples, the condenser may be in the compartment 121. This is to permit heat to be exchanged between refrigerant in the condenser 130 (which, as with the evaporator 110, may comprise a heat-and-tube heat exchanger or any other suitable heat exchanger), and an external atmosphere surrounding the storage unit (herein an "ambient atmosphere"). The expansion valve 140 is located within the atmosphere control system 20 and inside the storage unit 10, but may alternatively be located in any other suitable location.

The components of the refrigeration system 100 are fluidically coupled by respective conduits, which are shown as directional arrows in FIG. 1. The conduits are configured to pass refrigerant between the respective components, specifically in the direction of the arrows. A person skilled in the art of refrigeration systems will understand the principals of operation of the refrigeration system 100; however, for the avoidance of doubt, one mode of operation is described here.

The compressor 120 is operable to provide refrigerant in the form of a high-pressure, high-temperature gas to the condenser 130. That is, the condenser is on a "high-temperature" side of the refrigeration system 100. It will be understood that the term "high", here, is with respect to refrigerant being passed through the evaporator 110, which is on a "low-temperature" side of the refrigeration system 100. The temperature of the refrigerant in the condenser is higher than that of the ambient atmosphere. As such, latent heat stored in the refrigerant is transferred to the ambient atmosphere to cause the refrigerant to at least partly condense as it passes through the condenser 130. The refrigerant is supplied to the expansion valve 140 from the condenser 130 in a liquid phase, or part-liquid, phase. The refrigerant may be "subcooled" in the condenser, which is to lower the temperature of the refrigerant to below its saturation temperature at the pressure in the condenser 130. That is, sensible heat from the liquid refrigerant may be transferred to the ambient atmosphere to subcool the refrigerant upstream of the evaporator. For this reason, the conduit connecting the condenser 130 and the expansion valve 140 may be referred to herein as the "liquid line".

The expansion valve comprises an orifice through which the refrigerant is passed to reduce a pressure of the refrigerant entering the evaporator 110. The drop in pressure reduces a saturation temperature of the refrigerant, causing at least some of the liquid refrigerant to change phase into a vapour. This change of phase causes a reduction in temperature of the refrigerant, as some of the sensible heat in the refrigerant is converted into latent heat. The expansion valve 140 is here an electronically-controlled expansion valve, which may provide improved control of the expansion of refrigerant in the expansion valve. In other examples, the expansion valve is a thermal expansion valve ("TEV"), a manual valve, a capillary tube, or any other suitable type of expansion valve.

The low-temperature, two-phase refrigerant from the expansion valve 140 is passed through the evaporator 110, where any remaining liquid in the refrigerant is evaporated. Specifically, the refrigerant receives heat from the external gas, or "external fluid", being passed through the evaporator 110 due to the action of the evaporator gas moving device 131. This heat is stored as latent heat in the refrigerant as the refrigerant is evaporated, thereby removing heat from the external gas, which is then passed into the space 12 of the storage unit 10. The refrigerant is "superheated" in the evaporator, meaning it is elevated to a temperature above its saturation temperature at the pressure in the evaporator 110, or in the "suction line" leading from the evaporator back to the compressor 120. This ensures that any refrigerant entering the compressor 120 is fully evaporated, because any liquid refrigerant entering the compressor 120 may reduce an efficiency and/or longevity of the compressor 120.

Figure 2:
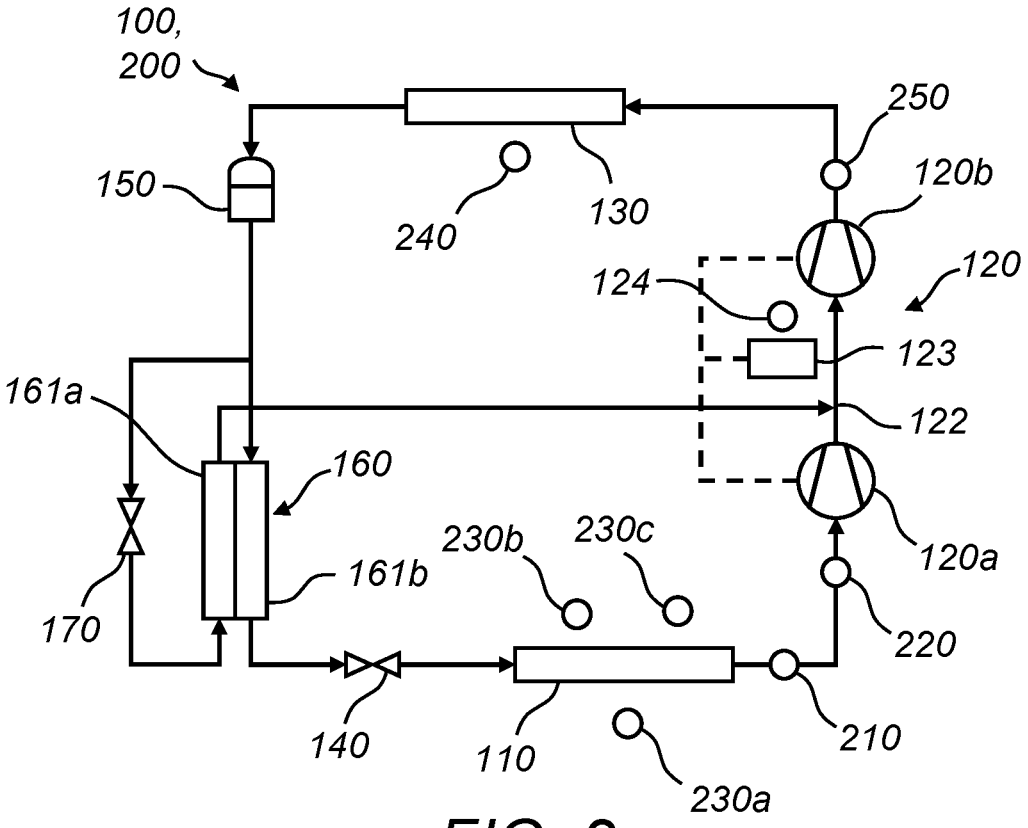
FIG. 2 shows an example refrigeration system of the storage unit of FIG. 1.

Turning now to FIG. 2, shown is a more detailed schematic diagram of the refrigeration system 100 shown and described in relation to FIG. 1. Specifically, the refrigeration system 100 of the present example comprises further components which have been omitted from FIG. 1 for clarity. Specifically, the refrigeration system 100, as shown in FIG. 2, comprises a two-stage compressor 120, specifically a two-stage piston compressor 120, comprising a compressor low stage 120*a* and a compressor high stage 120*b*. The compressor low stage 120*a* is configured to receive low-pressure, low-temperature refrigerant leaving the evaporator 110, while the compressor high stage 120*b* is configured to supply high-pressure, high-temperature refrigerant to the condenser 130.

The refrigeration system 100 comprises a liquid receiver 150 located in the liquid line connecting the condenser 130 and the expansion valve 140. The liquid receiver 150 is configured to store liquid received from the condenser 130, which can then be passed to the expansion valve 140. This can be to store excess refrigerant which may be present in the refrigeration system 100, such as due to changes in a temperature of the ambient atmosphere and/or a temperature of the external gas that is passed through the evaporator 110. It may also ensure that the refrigerant supplied to the expansion valve 140 is entirely in a liquid phase. This may improve a performance of the refrigeration system 100.

The refrigeration system 100 also comprises an economiser heat exchanger 160, which is located between the liquid receiver 150 and the expansion valve 140, and an economiser expansion valve 170. The economiser expansion valve 170 is configured to receive and "expand" some of the liquid refrigerant from the liquid receiver 150. That is, some of the refrigerant passing through the liquid line is tapped off and passed through the economiser expansion valve 170. The refrigerant expanded in the economiser expansion valve 170 is passed through a first side 161*a* of the economiser heat exchanger 160, while refrigerant from the liquid receiver 150 is passed through a second side 161*b* of the economiser heat exchanger 160 towards the expansion valve 140. The refrigerant passed through the first side 161*a* of the economiser heat exchanger 160 is at a lower temperature than the refrigerant passed through the second side 161*b*, due to its expansion through the economiser expansion valve 170. This causes further sub-cooling of the refrigerant passed to the expansion valve 140, which can improve an overall efficiency of the refrigeration system 100. The refrigerant from the economiser expansion valve 170 is evaporated in the economiser heat exchanger 160 and is received by the compressor high stage 120*b*, such as via an economiser port 123 of the compressor 120. It will be understood that the economiser port 123 may open into the compressor 120 at a location such that a pressure at the economiser port 123 is between a pressure at an inlet of the compressor low stage 120*a* and an outlet of the compressor high stage 120*b*. In this way, the pressure drop across the economiser expansion valve 160 is lower than the pressure drop across the expansion valve 170, but it still sufficient to enable further sub-cooling of the refrigerant entering the expansion valve 170. In some examples, refrigerant from the economiser expansion valve 140 and the first side 161*a* of the economiser heat exchanger 160 is used to reduce a temperature of a frequency convertor 123 of the compressor 120. The frequency convertor 123 shown in FIG. 2 is configured to drive respective motors of the compressor low stage 120*a* and compressor high stage 120*b*. The frequency convertor 123, or a part thereof, is located in proximity to the economiser port 122, so that heat can be exchanged between the frequency convertor 123 and the refrigerant from the economiser port 122. In some examples, this is to maintain the temperature of the frequency convertor 123, such as sensed by a frequency converter temperature sensor 124 below a predetermined temperature threshold of the frequency converter 123.

The refrigeration system 100 comprises a sensor system 200 comprising various sensors for sensing thermofluidic parameters and/or performance characteristics of the system. Specifically, the refrigeration system 100 comprises a suction line temperature sensor 210 located between the evaporator 110 and the compressor low stage 120*a* and configured to sense a temperature of refrigerant in, or leaving the evaporator 110. The refrigeration system 100 also comprises a suction line pressure sensor 220 located in the suction line between the evaporator 110 and the compressor low stage 120*a*. The suction line pressure sensor 220 can be used to determine a pressure of refrigerant in the low-temperature side of the refrigeration system 100, such as a pressure of the refrigerant in, and/or leaving the evaporator 110. The pressure sensed by the suction line pressure sensor 220 can be used to infer a saturation temperature of the refrigerant in the evaporator 110. The saturation temperature can then be compared to the temperature sensed by the suction line temperature sensor 210 to determine a level of superheat of the refrigerant. The expansion valve 140 may be controlled on the basis of the determined superheat, such as to increase or decrease a pressure drop across the expansion valve 140, and/or to adjust a quantity of refrigerant supplied to the evaporator, to adjust the superheat to a target superheat set point.

The sensor system 200 also comprises a supply gas temperature sensor 230*a* and a return gas temperature sensor 230*b*. As shown in FIG. 1, the supply gas temperature sensor 230*a* is located downstream of the evaporator 110 with respect to the external gas flowing through the atmosphere control system 20 when the gas is received from the space 12 via the second port 21*b* and supplied to the space 12 via the first port 12*a*. Similarly, the return gas temperature sensor 230*b* is located upstream of the evaporator 110 with respect to the external gas flowing through the atmosphere control system 20 when the gas is received from the space 12 via the second port 21*b* and supplied to the space 12 via the first port 12*a*. In other words, the return gas temperature sensor 230*b* is configured to sense a temperature of "return" gas received by the atmosphere control system 20 from the space 12, while the supply gas temperature sensor 230*a* is configured to sense a temperature of "supply" gas supplied to the space 12 by the atmosphere control system 20. As such, if the external gas from the space 12 is passed through the atmosphere control system, such as by operating the evaporator gas moving device 111 in a reverse direction, then the supply and return gas temperature sensors 230*a*, 230*b* may be correspondingly switched. In other examples, the supply and return gas temperature sensors 230*a*, 230*b* may be located in any other suitable location in the storage unit 10, such as in or near the respective first and second ports 21*a*, 21*b*. In some examples, there may be more than one supply gas temperature sensor 230*a*, and/or more than one return gas temperature sensor 230*b*, which may each located in different parts of the atmosphere control system 20 and/or the storage unit 10.

The sensor system 200 also comprises a relative humidity sensor 230*c* configured to determine a relative humidity of (i.e. a water content of) the external gas flowing through the evaporator 110. The relative humidity sensor 230*c* is shown in FIG. 2 as being on the same side of the evaporator 110 as the return gas temperature sensor 230*b*, such as to sense a relative humidity of the return gas. However, as with the supply and return gas temperature sensors 230*a*, 230*b*, the relative humidity sensor 230*c* may be located in any suitable location in the atmosphere control system 20 and/or storage unit 10, such as upstream or downstream of the evaporator 110, which, in some examples, may depend on the direction of flow of the external gas across the evaporator 110.

The sensor system 200 also comprises an ambient temperature sensor 240 configured to sense a temperature of the ambient atmosphere surrounding the storage unit. More specifically, the ambient temperature sensor 240 is located, as shown in FIG. 1, near to the condenser 130 in order to sense a temperature of the ambient atmosphere being moved through the condenser 130 by the condenser gas moving device 131.

Finally, the sensor system 200 comprises a discharge pressure sensor 250 located between the compressor high stage 120*b* and the condenser 130 and configured to sense a pressure of refrigerant discharged by the compressor high stage 120*b*.

It will be understood that, in other examples, the refrigeration system 100 may comprise any other suitable sensor system 200, such as a sensor system containing only one or a subset of the sensors in the sensor system 200 shown in FIG. 2, and/or any other sensors particular to the application at hand, such as mass flow sensors, or a liquid level sensor to sense a level of liquid refrigerant in the liquid receiver 150. It will also be understood that, in other examples, there may be no economiser heat exchanger 160 or economiser expansion valve 160, and/or the compressor 120 may be only a single-stage compressor. Other configurations of the refrigeration system 100 not described here may be conceivable.

Figure 3:
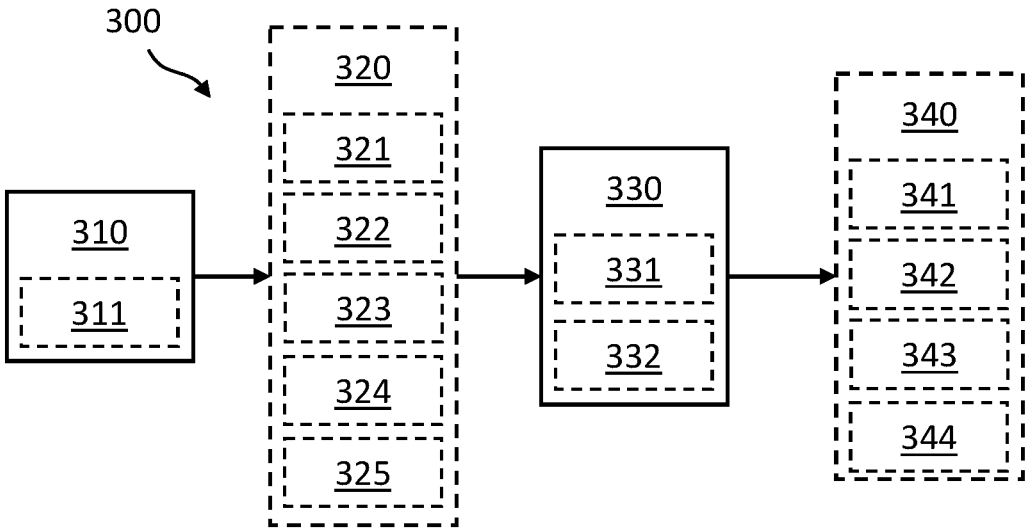
FIG. 3 shows an example method of determining a loss of charge in the refrigeration system of FIGS. 1 and 2.

FIG. 3 shows an example method 300 of determining a loss of charge of refrigerant in a refrigeration system 100, specifically, according to an example, the refrigeration system 100 shown in FIG. 2. The method 300 comprises determining 310 at least one performance characteristic of the refrigeration system 100, wherein the at least one performance characteristic comprises a mass flow rate of the refrigerant in the refrigeration system 100. The method 300 further comprises, when one or more predetermined criteria are met on the basis of the performance characteristic, determining 330 a loss of charge in the refrigeration system 100. In some examples, the method 300 comprises determining 320 whether the one or more predetermined criteria have been met, and determining 300 the loss of charge on the basis of a determination that the one or more predetermined criteria have been met.

In some examples, the determining 310 the at least one performance characteristic comprises measuring 311 one or more thermofluidic parameters of refrigerant in the refrigeration system 100. The at least one performance characteristic can then be determined on the basis of one or more other previously-determined performance characteristics, and/or based on one or more of the measured thermofluidic parameters, such as pressures and/or temperatures of refrigerant in the refrigeration system 100.

For instance, in the illustrated example, the at least one performance characteristic comprises an expansion valve mass flow rate, being a mass flow rate of refrigerant through the expansion valve 140, and a compressor low stage mass flow rate, being a mass flow rate of refrigerant through the compressor low stage. The expansion valve mass flow rate can be determined on the basis of physical properties of the expansion valve 140, a pressure drop across the expansion valve 140, and one or more other thermofluidic parameters of refrigerant entering the valve, such as a density of the refrigerant. The pressure drop across the valve can be determined broadly as a difference between a discharge pressure measured using the discharge pressure sensor 250 and a suction pressure measured using the suction line pressure sensor 220. The compressor low stage mass flow rate can be determined based on physical and/or performance characteristics of the compressor low stage 120*a*, such as, for example, an efficiency of the compressor low stage 120*a*, a swept volume of, e.g., a piston of the compressor low stage 120*a*, a running speed or frequency of the compressor low stage 120*a*, and/or one or more thermodynamic properties such as a density of the refrigerant entering the compressor low stage 120*a*.

In the illustrated example, the one or more predetermined criteria being met comprises a differential mass flow rate, being a comparison, such as a ratio or a difference, between the compressor low stage mass flow rate and the expansion valve mass flow rate, exceeding a mass flow rate threshold. Specifically, the determining 320 whether the one or more predetermined conditions has been met comprises determining 324 whether the differential mass flow rate exceeds the mass flow rate threshold. The determining 324 whether the differential mass flow rate exceeds the mass flow rate threshold may be referred to herein as the "intermediate mass flow determination 324". Such a disparity between the expansion valve 140 and compressor low stage 120*a* mass flow rates, particularly where the expansion valve 140 mass flow rate is higher than the compressor low stage 120*a* mass flow rate, can be indicative of a loss of charge of refrigerant in the refrigeration system 100. In some examples, a loss of charge reduces a liquid level in the receiver 150, which may cause vaporous refrigerant to enter the liquid line between the receiver 150 and the expansion valve 160. Vapour present at the expansion valve 160 occupies disproportionally more volume in an orifice of the expansion valve 160 than liquid refrigerant, and thereby reduces an effective mass flow rate through the expansion valve 160. The orifice of the expansion valve 160 is therefore opened further to compensate for this restriction, leading to an increased mass flow rate through the expansion valve 160 compared to the mass flow rate through the compressor, which may remain unchanged.

In other examples, the at least one performance characteristic comprises: an economiser valve mass flow rate, being a mass flow rate of refrigerant through the economiser valve 170, and a compressor high stage mass flow rate, being a mass flow rate of refrigerant through the compressor high stage 120*b*. The economiser valve mass flow rate and compressor high stage mass flow rate can be determined in a similar way to the expansion valve mass flow rate and compressor low stage mass flow rate described above, respectively. In such examples, the differential mass flow rate is a comparison, such as a ratio or a difference, between: the compressor high stage mass flow rate; and a sum of the economiser valve mass flow rate and the compressor low stage mass flow rate. In other words, if there has been no, or minimal, loss of charge, the compressor high stage mass flow rate should be roughly equal to a sum of the economiser valve mass flow rate and the compressor low stage mass flow rate. A loss of charge can lead to vaporous refrigerant entering the economiser valve 170, leading to a change in the mass flow rate through the economiser valve 170 in a similar way as to the expansion valve 160 as described above.

In some examples, the at least one performance characteristic also comprises an amount of superheat of refrigerant, specifically an amount of superheat of refrigerant leaving the evaporator 110 determined using a temperature of refrigerant as measured using the suction line temperature sensor 210 and a pressure of refrigerant as measured using the suction line pressure sensor 220 as discussed above. In some such examples, the determining 320 whether the predetermined criteria have been met comprises determining 323 whether the amount of superheat exceeds a superheat threshold, which may be referred to herein as the "intermediate superheat determination 323".

In some examples, the determining 320 whether the one or more predetermined conditions has been met comprises determining 322 whether the differential mass flow rate is greater than a further mass flow rate threshold, which is greater than the mass flow rate threshold. This may be referred to herein as the "principal mass flow determination 322". In further examples, the determining 320 whether the one or more predetermined conditions has been met comprises determining 321 whether the amount of superheat is greater than a further superheat threshold, which is greater than the superheat threshold. This may be referred to herein as the "principal superheat determination 321".

In some examples, the intermediate superheat and mass flow determinations 323, 324 are performed in the event of a negative principal superheat and/or mass flow determination 321, 322. In other words, the intermediate superheat and mass flow determinations 323, 324 may be performed in the event that the superheat is less than or equal to the further superheat threshold and/or the mass flow rate is less than or equal to the further mass flow rate threshold. Alternatively, a positive principal superheat determination and/or a positive mass flow determination may be indicative of a loss of charge of refrigerant in the refrigeration system 100.

Figure 4:
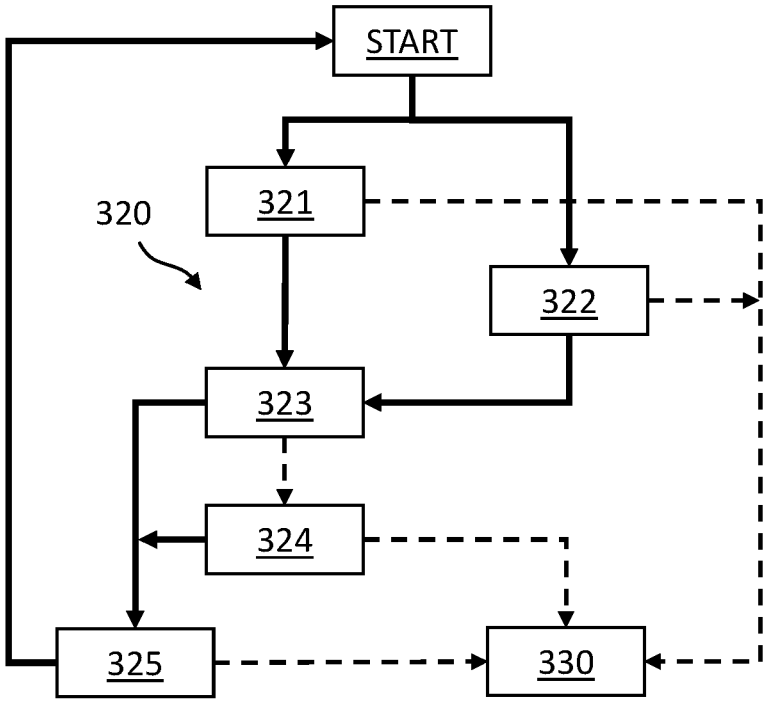
FIG. 4 shows a flow chart of an example process for determining a loss of charge in accordance with the method of FIG. 3.

An example decision making process for determining 320 whether the predetermined condition has been met, and determining 330 there has been a loss of charge in the refrigeration system 100, is shown more clearly in FIG. 4. Specifically, FIG. 4 shows each of the principal and intermediate superheat and mass flow determinations 321 to 324, the determining 330 the loss of charge, as well as a further "refrigeration cycle abnormality determination 325", which will be described in more detail hereinafter. A dotted line shows the result of a positive determination (i.e. the respective predetermined condition has been met), while a solid line shows the result of a negative determination (i.e. the respective predetermined condition has not been met).

It can be seen that, in this example, the method 300 comprises determining 330 that there has been a loss of charge of refrigerant in the refrigeration system 100 in the event of any one of the following situations: a positive principal superheat determination 321; a positive principal mass flow determination 322; a positive intermediate superheat determination 323 and a positive intermediate mass flow determination 324; or a positive refrigeration cycle abnormality determination 325.

It will be understood that the intermediate superheat determination 323 may be performed in the event of either or both of the principal superheat and mass flow determinations being negative. It will also be appreciated that the order of the intermediate superheat and mass flow determinations 323, 324 may be switched. In this way, a loss of charge may be accurately determined by establishing that either the superheat or mass flow (specifically, the differential mass flow rate) is greater than the respective further superheat or further mass flow thresholds and, if neither are above their respective further thresholds, establishing that both: the superheat is greater than the superheat threshold and up to the further superheat threshold; and the differential mass flow rate is greater than the mass flow rate threshold and up to the further mass flow rate threshold.

The refrigeration cycle abnormality determination 325 is therefore, in the illustrated example, performed in the event of negative principal superheat and mass flow determinations 321, 322, and negative intermediate mass flow determinations 323, 324. The refrigeration cycle abnormality determination 325 here provides a further way to determine 330 a loss of charge in the refrigeration system 100, such as in the event that the other determinations described above are inconclusive, or in the event that no loss of charge is identified using the previously-described determinations, thereby improving a reliability of the method 300.

In examples, the one or more performance characteristics used in the refrigeration cycle abnormality determination 325 comprise any one or more of: a refrigerant capacity, being a capacity of refrigerant flowing through the evaporator 110; a fluid capacity, being a rate of heat transfer from the external gas, or more broadly "fluid", cooled by the evaporator 110; a level of subcooling of refrigerant in the refrigeration system 100, such as a difference between a saturation temperature of refrigerant at the pressure in the condenser 130, and a temperature of refrigerant in the liquid line between the condenser 130 an the expansion valve 140, such as downstream of the economiser heat exchanger 160; and a coefficient of performance of the refrigeration system 100, such as a level of cooling of the external gas achieved by the refrigeration system 100 compared to a power input, such as a total power input to the compressor 120.

A change in any one of these performance characteristics may be indicative of a loss of charge of refrigerant in the refrigeration system 100. As such, the one or more predetermined criteria being met here comprises any one or more of: the refrigerant capacity meeting, or exceeding, a theoretical maximum of the fluid capacity; the subcooling of refrigerant meeting, or reducing below a subcooling threshold; and the coefficient of performance meeting, or reducing below a performance threshold. The refrigeration cycle abnormality determination 325 here comprises determining 325 whether: the refrigerant capacity meets, or exceeds, the theoretical maximum fluid capacity; the subcooling of refrigerant meets, or is below, the subcooling threshold; and/or the coefficient of performance meets, or is below, the performance threshold.

In some examples, the one or more performance characteristics comprise a flow rate of the external gas through the evaporator 110 and/or the condenser 130; a speed of the evaporator and/or condenser gas moving device 111, 131; and a speed, or frequency, of the compressor 12, or the individual compressor high and/or low stages 120*a*, 120*b*. As indicated above, any one or more of the performance characteristics may be determined based on any other of the one or more performance characteristics, and/or thermofluidic parameters of the refrigerant and/or external gas associated with the refrigeration system 100. For example, the refrigerant capacity can be determined on the basis of the expansion valve mass flow rate and an enthalpy change of refrigerant as it passes through the evaporator 110. The enthalpy change can be determined, for instance, based on the suction pressure determined using the suction line pressure sensor 220, the level of subcooling of refrigerant described above, and the level of superheat of refrigerant described above.

Where the refrigerant capacity is determined on the basis of the expansion valve mass flow rate, then an increase in the mass flow rate through the expansion valve 160, such as due to a loss of charge, as described above, can lead to an increase in the determined refrigerant capacity. The refrigerant capacity may normally be expected to be a factor of the theoretical maximum fluid capacity, wherein the factor is between 0 (zero) and 1 (one) in dependence on an efficiency of the evaporator 110. In a perfect heat exchanger, such as a theoretical infinitely long evaporator 110, the factor would be 1 (one), and the refrigerant capacity would equal the theoretical maximum fluid capacity. A loss of charge of refrigerant in the refrigeration system 100 may cause the determined refrigerant capacity to exceed the theoretical maximum fluid capacity, indicating a problem with the refrigeration system 100. As such, the refrigerant capacity exceeding the theoretical maximum fluid capacity is a strong indication of a loss of charge in the refrigeration system 100.

Similarly, in some examples, the fluid capacity can be determined based on: a mass flow of the external fluid through the evaporator 110, such as determined based on the speed of the evaporator gas moving device 111; a logarithmic mean temperature distribution (LMDT) of the external gas, such as determined based on thermofluidic parameters comprising the supply gas temperature sensed by the supply gas temperature sensor 230*a*, the return gas temperature sensed by the return gas temperature sensor 230*b*, and the suction pressure determined using the suction pressure sensor 220; and a relative humidity of the external gas, such as sensed using the relative humidity sensor 230*c*.

It will be appreciated that other performance characteristics and/or thermofluidic parameters may be used in other examples to determine any one or more of the performance characteristics described above, such as a density of the external gas, an enthalpy of water and/or ice in the external gas, a specific heat of the external gas and/or refrigerant; a refrigerant and/or external fluid capacity of the condenser 130; or any other suitable performance characteristics and/or thermofluidic parameters.

In the event that the refrigeration cycle abnormality determination 325 is negative, then no loss of charge of refrigerant is determined and the process begins again. In some examples, the refrigeration cycle abnormality determination 325 is performed in tandem with the principal and intermediate superheat and mass flow determinations 321 to 324, such as in a continual loop. This may particularly be the case when the refrigeration cycle abnormality determination 325 takes longer to perform than each of the principal and intermediate superheat and mass flow determinations 321 to 324. Indeed, in some examples, plural principal superheat and/or mass flow determinations 321, 322, and/or plural intermediate superheat and/or mass flow determinations 323, 324, can be performed in the time it takes to perform the refrigeration cycle abnormality determination 325. The principal and/or intermediate superheat and/or mass flow determinations 321 to 324 may therefore provide a quicker way of determining 330 the loss of charge compared to the refrigeration cycle abnormality determination 325, thereby improving a reliability of the method 300. However, the refrigeration cycle abnormality determination 325, while taking longer to perform, may be better able detect a loss of charge, thereby also improving a reliability and accuracy of the method 300.

In some examples one or more of the principal superheat determination 321, the principal mass flow determination 322, the intermediate superheat determination 323, and the intermediate mass flow determination 324, is performed periodically, such as at intervals of up to five minutes, up to ten minutes, up to fifteen minutes, up to thirty minutes, up to one hour, or more than one hour. In some examples, one or more of the principal superheat determination 321, the principal mass flow determination 322, the intermediate superheat determination 323, and the intermediate mass flow determination 324, is performed using sensed data that is continuously and/or intermittently monitored over a predetermined period of time, such as over a period of up to five minutes, up to ten minutes, up to fifteen minutes, up to thirty minutes, up to one hour, or more than one hour. In some examples, the compressor 120 is operable in discrete intervals of time, which may be variable intervals of time, in order to provide a desired cooling profile. In some examples, any one or more of the principal superheat determination 321, the principal mass flow determination 322, the intermediate superheat determination 323, and the intermediate mass flow determination 324, is performed during a respective interval when the compressor 120 is operating.

In some examples, the refrigeration cycle abnormality 325 determination is performed periodically, such as at intervals of up to thirty minutes, up to one hour, up to two hours, or more than two hours. In some examples, the refrigeration cycle abnormality determination 325 is performed using sensed data that is continuously and/or intermittently monitored over a predetermined period of time, such as over a period of up to thirty minutes, up to one hour, up to two hours, or more than two hours.

It will be appreciated that, in other examples, the refrigeration cycle abnormality determination 325 comprises analysing any other suitable performance characteristic(s) of the refrigeration system 100 to determine a loss of charge of refrigerant in the refrigeration system 100.

In some examples, the determining 330 a loss of charge comprises determining 331 a quantity of refrigerant that has been lost from the refrigeration system 100. In further examples, the determining 330 the loss of charge comprises determining 332 that the quantity of refrigerant lost exceeds a charge threshold. The charge threshold is, for instance, a predetermined amount of refrigerant that can allowably be lost from the refrigeration system 100. Alternatively, or in addition, an amount of refrigerant remaining in the refrigeration system 100 may be determined, and a loss of charge of refrigerant may be determined when the amount of remaining refrigerant in the refrigeration system 100 drops below a refrigerant level threshold.

In some examples, the charge threshold is an amount of refrigerant that could be lost while maintaining a level of performance of the refrigeration system 100 within an allowable performance range. In some examples, the charge threshold is an amount of refrigerant that could be lost without posing a safety risk, such as a fire hazard. For instance, an amount of refrigerant that can safely be allowed to accumulate in the space 12. In some examples, the charge threshold is up to 1 kg of refrigerant, up to 1.5 kg of refrigerant, up to 2 kg of refrigerant, up to 3 kg of refrigerant, or more than 3 kg of refrigerant. In some examples, the charge threshold is up to 25%, up to 50%, or up to 75% of a nominal amount of refrigerant in the refrigeration system 100.

In some examples, following a positive determination of a loss of charge in the refrigeration system 100, the method 300 comprises causing 340 remedial action to be taken. The remedial action comprises, for example, any one or more of: causing 341 issuance of an alert; limiting 342 operation of, such as by preventing operation of, the refrigeration system 100; causing 343 modification of an atmosphere conditioned by the refrigeration system 100; and causing 344 supply of refrigerant to the refrigeration system 100.

The causing 341 issuance of an alert comprise causing issuance of a visual and/or audible alarm, such as by a remote control system as described below. This could be to alert a competent person to the loss of charge, who may then take remedial action as appropriate to the situation. The limiting 342 operation of the refrigeration system 100 may limit a further loss of charge, and/or may limit a power draw of the refrigeration system 100. The causing 343 modification of the atmosphere may comprise, for example, changing a composition of the gas supplied to the space 12 so as to inhibit ripening of produce in the space, such as by injecting CO2 or an ethylene-blocker into the gas, or by reducing an amount of ethylene and/or O2 in the gas. This may inhibit ripening of produce in the event that the cooling capacity of the refrigeration system 100 is reduced due to the loss of charge. The causing 344 supply of refrigerant to the refrigeration system 100 is here to "top-up" the refrigerant in the refrigeration system 100, such as to replace the lost refrigerant from the refrigeration system 100. This may be done automatically, such as by automatically coupling the refrigeration system 100 to a supply of refrigerant, or manually, such as by a competent person re-charging the refrigeration system 100, such as before, during or after the cause of the loss of charge has been identified and/or remedied.

Figure 5:
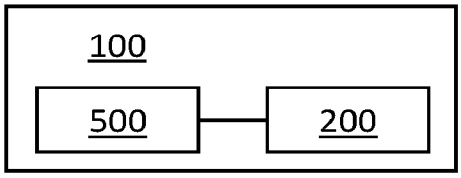
FIG. 5 shows a schematic diagram of the refrigeration system 100 of FIGS. 1 and 2 comprising a controller.

Turning now to FIG. 5, shown is a schematic diagram of the refrigeration system 100 comprising a controller 500 and the sensor system 200. In the present example, the controller 500 is a part of the refrigeration system 100, and is configured to control an operation of the refrigeration system 100. In other examples, another controller is configured to control the operation of the refrigeration system 100. In either case, the controller 500 is configured to perform the method 300 described above to determine a loss of charge in the refrigeration system 100, such as by using signals received from the sensor system 200. In other examples, the controller is comprised in the transport unit 10 and/or the atmosphere control system 20. In other examples, the controller 500 is a remote controller, such as comprised in a marine vessel, or in a cloud-based computing system, and is communicatively coupled, or couplable, to the refrigeration system 100, such as to a separate controller thereof, and/or to the sensor system 200. In some such examples, the controller 500 is configured to determine a loss of charge in one or more different refrigeration systems 100.

Figure 6:
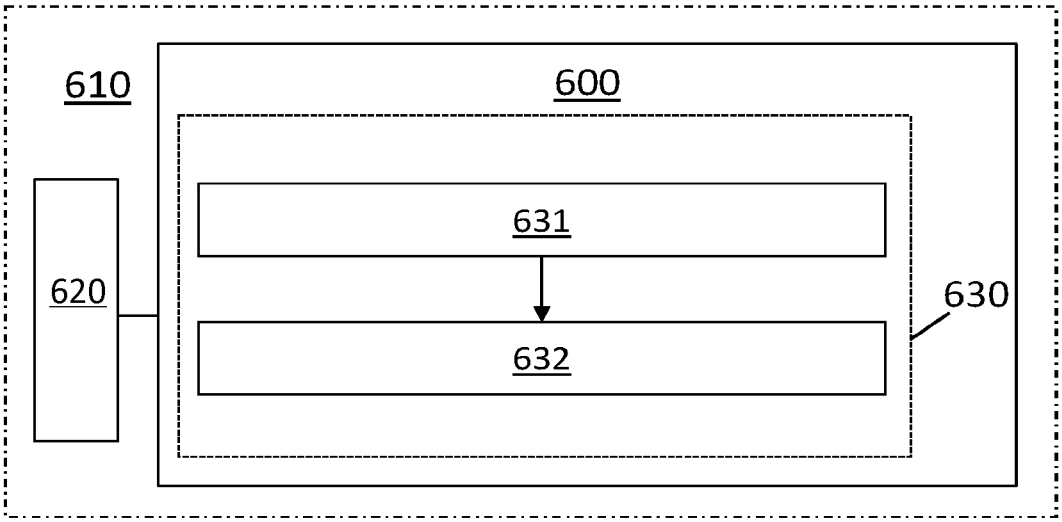
FIG. 6 shows a schematic diagram of a non-transitory computer-readable storage medium according to an example.

FIG. 6 shows a schematic diagram of a non-transitory computer-readable storage medium 600 according to an example. The non-transitory computer-readable storage medium 600 stores instructions 630 that, if executed by a processor 620 of a controller 610, cause the processor 620 to perform a method according to an example. In some examples, the controller 610 is the controller 500 as described above with reference to FIG. 5 or any variation thereof discussed herein. The instructions 630 comprise: determining 631 at least one performance characteristic of the refrigeration system 100; and, when one or more predetermined criteria are met on the basis of the performance characteristic, determining 632 a loss of charge in the refrigeration system 100. In other examples, the instructions 630 comprise instructions to perform any other example method described herein, such as the method 400 described above with reference to FIG. 4. In some examples, the refrigeration system 100 and/or the atmosphere control system 20, and/or the storage unit 10 comprises the non-transitory computer-readable storage medium 600.

Figure 7:
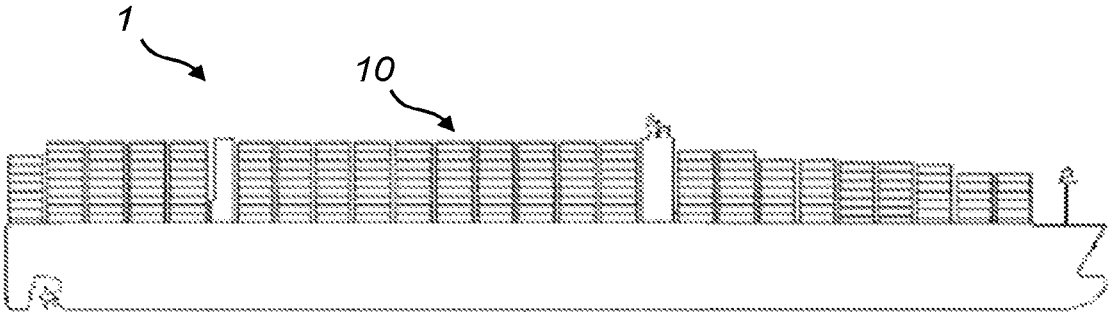
FIG. 7 shows an example marine vessel comprising the storage unit of FIG. 1.

FIG. 7 shows an example marine vessel 1, which here is a container ship. The marine vessel 1 comprises, and is configured to transport, the storage unit 10. In other examples, the marine vessel 10 comprises the controller 500, the non-transitory computer-readable storage medium 600, and/or the refrigeration system 100.

Example embodiments of the present invention have been discussed, with particular reference to the examples illustrated. However, it will be appreciated that variations and modifications may be made without departing from the scope of the invention as defined by the appended claims.

What is claimed is:

1. A method of determining a loss of charge of refrigerant in a refrigeration system, the method comprising:

determining at least one performance characteristic of the refrigeration system, wherein the at least one performance characteristic comprises a mass flow rate of the refrigerant through a compressor of the refrigeration system and a mass flow rate of the refrigerant through an expansion valve of the refrigeration system;

determining that one or more predetermined criteria are met on the basis of the at least one performance characteristic, the one or more predetermined criteria comprising a differential mass flow rate between the compressor mass flow rate and the expansion valve mass flow rate, wherein the compressor is a low-stage compressor of a two-stage compressor assembly, and the compressor mass flow rate is a compressor low stage mass flow rate;

determining a loss of charge in the refrigeration system based on the determination that the one or more predetermined criteria are met; and based on determining the loss of charge in the refrigeration system, causing a remedial action to be taken.

2. The method of claim 1, wherein the differential mass flow rate is a ratio between the compressor mass flow rate and the expansion valve mass flow rate, or a difference between the compressor mass flow rate and the expansion valve mass flow rate.

3. The method of claim 1, comprising, on the basis of a determination that the differential mass flow rate is less than or equal to a further mass flow rate threshold that is greater than the mass flow rate threshold, performing an intermediate mass flow determination, wherein the intermediate mass flow determination comprises determining whether the differential mass flow rate exceeds the mass flow rate threshold.

4. The method of claim 3, comprising performing a principal mass flow determination, the principal mass flow determination comprising determining whether the differential mass flow rate is greater than the further mass flow rate threshold.

5. The method of claim 4, wherein the loss of charge in the refrigeration system is determined on the basis of a positive principal mass flow determination.

6. The method of claim 1, wherein the at least one performance characteristic comprises an amount of superheat of refrigerant, the superheat being associated with an evaporator of the refrigeration system, and the one or more predetermined criteria being met comprises the amount of superheat exceeding a superheat threshold.

7. The method of claim 6, comprising performing an intermediate superheat determination, the intermediate superheat determination comprising determining whether the amount of superheat exceeds the superheat threshold, and determining the loss of charge in the refrigeration system on the basis of both a positive intermediate superheat determination and a positive intermediate mass flow determination.

8. The method of claim 7, comprising determining whether: the amount of superheat exceeds the superheat threshold, and whether the differential mass flow rate exceeds the mass flow rate threshold, on the basis of a determination that the amount of superheat is less than or equal to a further superheat threshold that is greater than the superheat threshold.

9. The method of claim 8, comprising performing a principal superheat determination, the principal superheat determination comprising determining that the amount of superheat is greater than the further superheat threshold;

wherein the loss of charge in the refrigeration system is determined on the basis of a positive principal superheat determination.

10. The method of claim 9, wherein the loss of charge in the refrigeration system is determined on the basis of:

a) one or both of a negative principal superheat determination and a negative principal mass flow determination; and b) both a positive intermediate superheat determination and a positive intermediate mass flow determination.

11. The method of claim 1, wherein the performance characteristic comprises any one or more of:

a refrigerant capacity, being a rate of heat transfer to refrigerant flowing through an evaporator of the refrigeration system;

a fluid capacity, being a rate of heat transfer from an external fluid cooled by the evaporator;

a level of subcooling of refrigerant in the refrigeration system; and a coefficient of performance of the refrigeration system; and wherein the one or more predetermined criteria being met comprises any one or more of:

the refrigerant capacity meeting, or exceeding, a theoretical maximum of the fluid capacity;

the subcooling of refrigerant meeting, or being below, a subcooling threshold; and the coefficient of performance meeting, or being below, a performance threshold.

12. The method of claim 11, comprising performing, in response to either a negative intermediate superheat determination or a negative intermediate mass flow determination, a refrigeration cycle abnormality determination, wherein the refrigeration cycle abnormality determination comprises:

determining whether: the refrigerant capacity meets, or exceeds, the theoretical maximum fluid capacity;

the subcooling of refrigerant meets, or is below, the subcooling threshold; and/or the coefficient of performance meets, or is below, the performance threshold.

13. The method of claim 1, wherein the remedial action comprises any one or more of:

causing issuance of an alert;

preventing operation of the refrigeration system;

causing modification of an atmosphere conditioned by the refrigeration system; and causing supply of refrigerant to the refrigeration system.

14. The method of claim 1, wherein the compressor mass flow rate is determined based on at least one of (i) an efficiency of the compressor, (ii) a swept volume of a piston of the compressor, (iii) a running speed or frequency of the compressor, or (iv) a density of the refrigerant entering the compressor.

15. A controller configured to perform operations comprising:

determining at least one performance characteristic of the refrigeration system, wherein the at least one performance characteristic comprises a mass flow rate of the refrigerant through a compressor of the refrigeration system and a mass flow rate of the refrigerant through an expansion valve of the refrigeration system;

determining that one or more predetermined criteria are met on the basis of the at least one performance characteristic, the one or more predetermined criteria comprising a differential mass flow rate between the compressor mass flow rate and the expansion valve mass flow rate, wherein the compressor is a low-stage compressor of a two-stage compressor assembly, and the compressor mass flow rate is a compressor low stage mass flow rate;

determining a loss of charge in the refrigeration system based on the determination that the one or more predetermined criteria are met; and based on determining the loss of charge in the refrigeration system, causing a remedial action to be taken.

16. A non-transitory computer-readable storage medium storing instructions that, if executed by a processor, cause the processor to perform operations comprising:

determining at least one performance characteristic of the refrigeration system, wherein the at least one performance characteristic comprises a mass flow rate of the refrigerant through a compressor of the refrigeration system and a mass flow rate of the refrigerant through an expansion valve of the refrigeration system;

determining that one or more predetermined criteria are met on the basis of the at least one performance characteristic, the one or more predetermined criteria comprising a differential mass flow rate between the compressor mass flow rate and the expansion valve mass flow rate, wherein the compressor is a low-stage compressor of a two-stage compressor assembly, and the compressor mass flow rate is a compressor low stage mass flow rate;

determining a loss of charge in the refrigeration system based on the determination that the one or more predetermined criteria are met; and based on determining the loss of charge in the refrigeration system, causing a remedial action to be taken.

17. A refrigeration system, comprising:

a compressor;

an expansion valve;

a condenser;

an evaporator; and a controller configured to perform operations comprising:

determining at least one performance characteristic of the refrigeration system, wherein the at least one performance characteristic comprises a mass flow rate of the refrigerant through a compressor of the refrigeration system and a mass flow rate of the refrigerant through an expansion valve of the refrigeration system;

determining that one or more predetermined criteria are met on the basis of the at least one performance characteristic, the one or more predetermined criteria comprising a differential mass flow rate between the compressor mass flow rate and the expansion valve mass flow rate, wherein the compressor is a low-stage compressor of a two-stage compressor assembly, and the compressor mass flow rate is a compressor low stage mass flow rate;

determining a loss of charge in the refrigeration system based on the determination that the one or more predetermined criteria are met; and based on determining the loss of charge in the refrigeration system, causing a remedial action to be taken.

18. A storage unit comprising space for storing cargo and a refrigeration system being operable to condition an atmosphere in the space, the refrigeration system comprising:

a compressor;

an expansion valve;

a condenser;

an evaporator; and a controller configured to perform operations comprising:

determining at least one performance characteristic of the refrigeration system, wherein the at least one performance characteristic comprises a mass flow rate of the refrigerant through a compressor of the refrigeration system and a mass flow rate of the refrigerant through an expansion valve of the refrigeration system, wherein the compressor is a low-stage compressor of a two-stage compressor assembly, and the compressor mass flow rate is a compressor low stage mass flow rate;

determining that one or more predetermined criteria are met on the basis of the at least one performance characteristic, the one or more predetermined criteria comprising a differential mass flow rate between the compressor mass flow rate and the expansion valve mass flow rate;

determining a loss of charge in the refrigeration system based on the determination that the one or more predetermined criteria are met; and based on determining the loss of charge in the refrigeration system, causing a remedial action to be taken.

19. A marine vessel, comprising:

a storage unit comprising space for storing cargo; and a refrigeration system, comprising:

a compressor;

an expansion valve;

a condenser;

an evaporator; and a controller, the controller comprising a non-transitory computer-readable storage medium storing instructions that, if executed by a processor, cause the processor to perform operations comprising:

determining at least one performance characteristic of the refrigeration system, wherein the at least one performance characteristic comprises a mass flow rate of the refrigerant through a compressor of the refrigeration system and a mass flow rate of the refrigerant through an expansion valve of the refrigeration system;

determining that one or more predetermined criteria are met on the basis of the at least one performance characteristic, the one or more predetermined criteria comprising a differential mass flow rate between the compressor mass flow rate and the expansion valve mass flow rate, wherein the compressor is a low-stage compressor of a two-stage compressor assembly, and the compressor mass flow rate is a compressor low stage mass flow rate;

determining a loss of charge in the refrigeration system based on the determination that the one or more predetermined criteria are met; and based on determining the loss of charge in the refrigeration system, causing a remedial action to be taken.

* * * * *